US009271884B2

(12) United States Patent
Mitchell

(10) Patent No.: US 9,271,884 B2
(45) Date of Patent: Mar. 1, 2016

(54) PERSONAL STORAGE ACCESSORY FOR WHEELCHAIRS

(71) Applicant: DESIGN PAR MITCHELL INC., Montreal (CA)

(72) Inventor: Raymond Larry Mitchell, Montreal (CA)

(73) Assignee: DESIGN PAR MITCHELL INC., Montreal, Quebec ( * ) Notice: Subject to any disclaimer, the term of this patent is extended or adjusted under 35 U.S.C. 154(b) by 124 days.

(21) Appl. No.: 14/106,429

(22) Filed: Dec. 13, 2013

(65) Prior Publication Data

US 2014/0166711 A1 Jun. 19, 2014

Related U.S. Application Data

(60) Provisional application No. 61/797,690, filed on Dec. 14, 2012.

(51) Int. Cl.
*A61G 5/10* (2006.01)

(52) U.S. Cl.
CPC ..... *A61G 5/10* (2013.01)

(58) Field of Classification Search
CPC ..... A61G 5/10; A61G 7/0503
USPC ..... 224/407; 248/282.1, 407, 447, 474, 479
See application file for complete search history.

(56) References Cited

U.S. PATENT DOCUMENTS 3,550,892 A * 12/1970 Propst ..... 248/282.1
3,625,405 A * 12/1971 Kezar et al. ..... 224/413
3,845,891 A * 11/1974 Becher ..... 224/42.21
4,185,801 A * 1/1980 Plymoth ..... 248/282.1
4,896,855 A * 1/1990 Furnish ..... 248/206.3
4,919,443 A * 4/1990 Kehler ..... 280/304.1
5,100,091 A * 3/1992 Pollak ..... 248/278.1
5,180,181 A * 1/1993 Letechipia ..... 280/304.1
5,299,824 A 4/1994 Roberts et al.
5,901,891 A 5/1999 Douglass
7,243,892 B2 * 7/2007 Pfister ..... 248/371
7,334,712 B2 2/2008 Hassett et al.
7,344,055 B2 3/2008 Macocha
7,651,111 B2 * 1/2010 Butler ..... A61G 5/10 280/304.1
7,845,667 B2 12/2010 Mahler et al.
8,496,260 B2 * 7/2013 Jutkiewicz ..... A61G 5/10 224/282
2004/0035995 A1 * 2/2004 Chen et al. ..... 248/282.1
2008/0156838 A1 * 7/2008 Johnson ..... 224/407
2009/0302570 A1 * 12/2009 Davis ..... A61G 5/10 280/304.1
2011/0233890 A1 9/2011 Jutkiewicz et al.

* cited by examiner

*Primary Examiner* — Adam Waggenspack
(74) *Attorney, Agent, or Firm* — Norton Rose Fulbright Canada

(57) ABSTRACT

A transfer device for moving a personal storage container from a storage position at the rear of a wheelchair to a deployed position at a side of the wheelchair. The device includes a bracket adapted to be mounted to the backrest frame and a swivel mechanism with a first hinge leaf rotationally mounted to the bracket for rotation about a first axis and a second hinge leaf rotationally mounted to the first hinge leaf about a second axis spaced apart from the first axis. The second hinge leaf has a portion adapted to mount the personal storage container. The portion adapted to mount the personal storage container moves along an arc contained within a plane between the storage and the deployed positions, and the first and second axes are normal to the plane. A personal storage container assembly is also provided.

14 Claims, 6 Drawing Sheets

PERSONAL STORAGE ACCESSORY FOR WHEELCHAIRS

CROSS-REFERENCE TO RELATED APPLICATIONS

This application claims priority on provisional U.S. application No. 61/797,690 filed Dec. 14, 2012, the entire contents of which are incorporated by reference herein.

TECHNICAL FIELD

The present invention relates to accessories for wheelchairs and in particular to a personal storage transfer device for a wheelchair.

BACKGROUND OF THE ART

Several patents exist showing various personal storage devices or backpacks which are movable between a first position behind a wheelchair to a second position sideways of the wheelchair whereby the storage device is more readily accessible to the wheelchair user. Such patents include, for example, U.S. Pat. No. 4,919,443 Kehler 1990; U.S. Pat. No. 5,180,181 Letechopia 1993; and U.S. Pat. No. 8,496,260 Jutkiewicz et al. 2013. However existing storage devices may be relatively expensive and/or complex.

SUMMARY

In one aspect, there is provided a transfer device for moving a personal storage container from a storage position at the rear of a wheelchair to a deployed position at a side of the wheelchair where the wheelchair includes a backrest frame, the transfer device comprising: a bracket adapted to be mounted to the backrest frame; and a swivel mechanism including a first hinge leaf rotationally mounted to the bracket for rotation about a first axis, and a second hinge leaf rotationally mounted to the first hinge leaf about a second axis spaced apart from the first axis, the second hinge leaf having a portion adapted to mount the personal storage container, the swivel mechanism being configurable between the storage position and the deployed position, the portion adapted to mount the personal storage container moving along an arc contained within a plane between the storage and the deployed positions, the first and second axes being normal to the plane.

In another aspect, there is provided a personal storage container assembly for a wheelchair movable between a storage position at the rear of a wheelchair to a deployed position at a side of the wheelchair where the wheelchair includes a backrest frame, the assembly comprising a personal storage container and a transfer device, the transfer device including a bracket adapted to be mounted to the backrest frame and a swivel mechanism including a first hinge leaf rotationally mounted to the bracket for rotation about a first axis, and a second hinge leaf rotationally mounted to the first hinge leaf about a second axis spaced apart from the first axis, the second hinge leaf mounting the personal storage container, the swivel mechanism being configurable between the storage position and the deployed position, the personal storage container moving along an arc contained within a plane between the storage and the deployed positions, the first and second axes being normal to the plane.

DESCRIPTION OF THE DRAWINGS

Reference will now be made to the accompanying drawings, showing by way of illustration particular embodiments of the present invention and in which.

DETAILED DESCRIPTION

Figure 1:
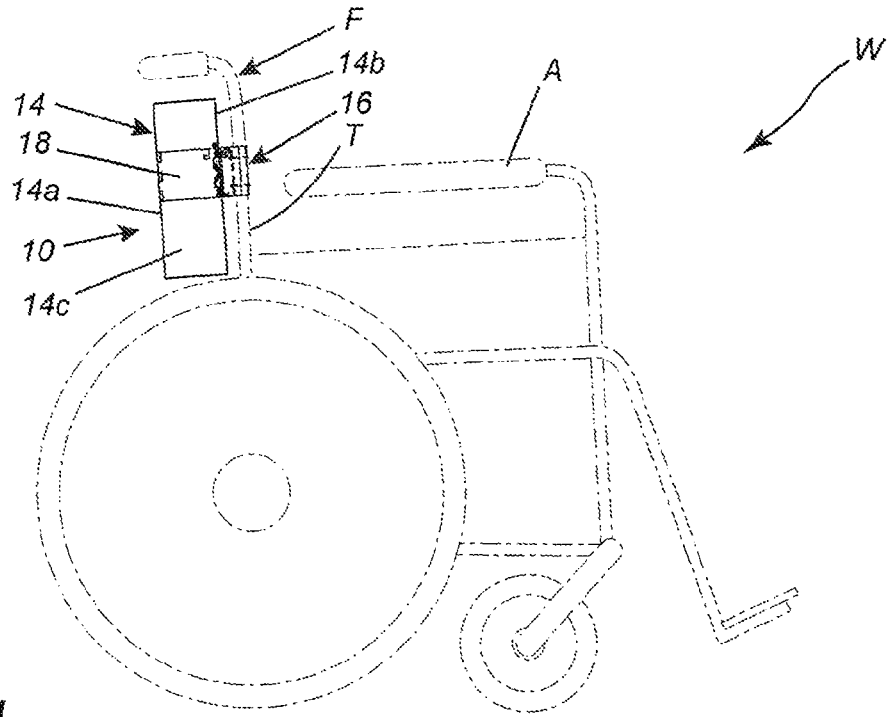
FIG. 1 is a side elevation, partly in dotted lines showing a typical manual wheelchair to which a personal storage transfer device in accordance with a particular embodiment is shown in full lines, mounted to the wheelchair.
Figure 2:
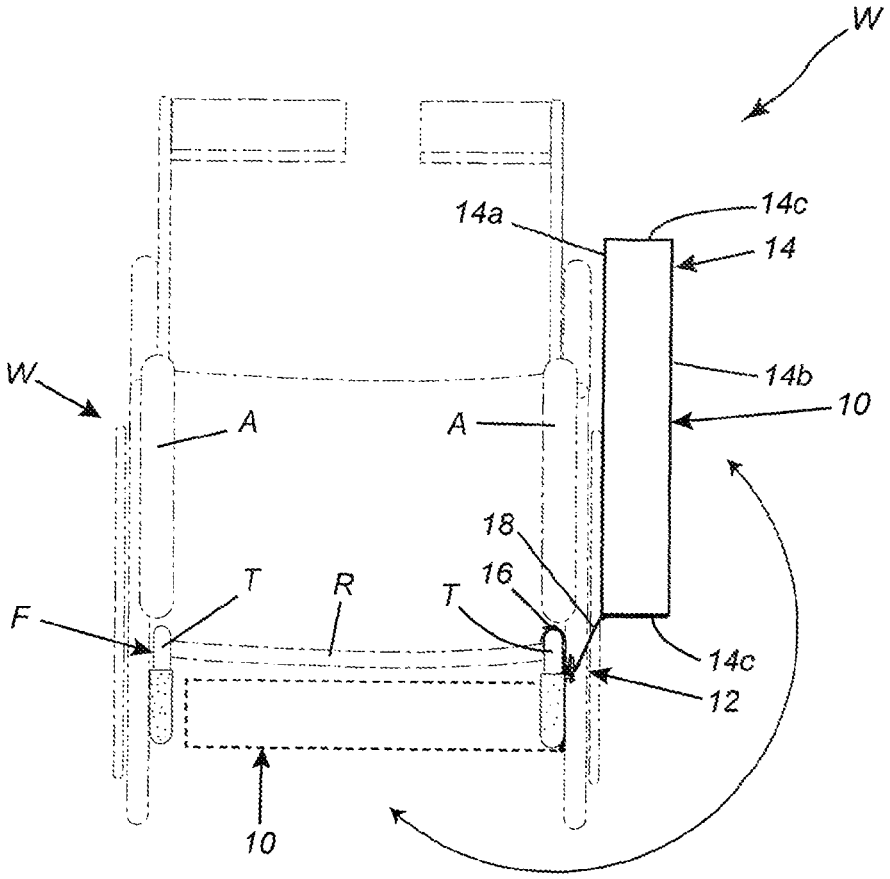
FIG. 2 is a top plan view of the wheelchair of FIG. 1 with the personal storage transfer device is shown in two different positions.

A wheelchair W is shown in FIGS. 1 and 2, in dotted lines. The wheelchair W includes a frame F having tubular frame members T on either side of a backrest R. Armrests A are also illustrated. A first embodiment of the personal storage transfer device is illustrated in FIGS. 1 and 2 showing a personal storage device 10 mounted to the tubular frame member T of wheelchair W. As shown in FIG. 2, the personal storage transfer device 10 is meant to rotate or swivel between a stored position, shown in dotted lines, at the rear of the backrest R, and an accessible position shown in full lines adjacent the armrest A.

Figure 3:
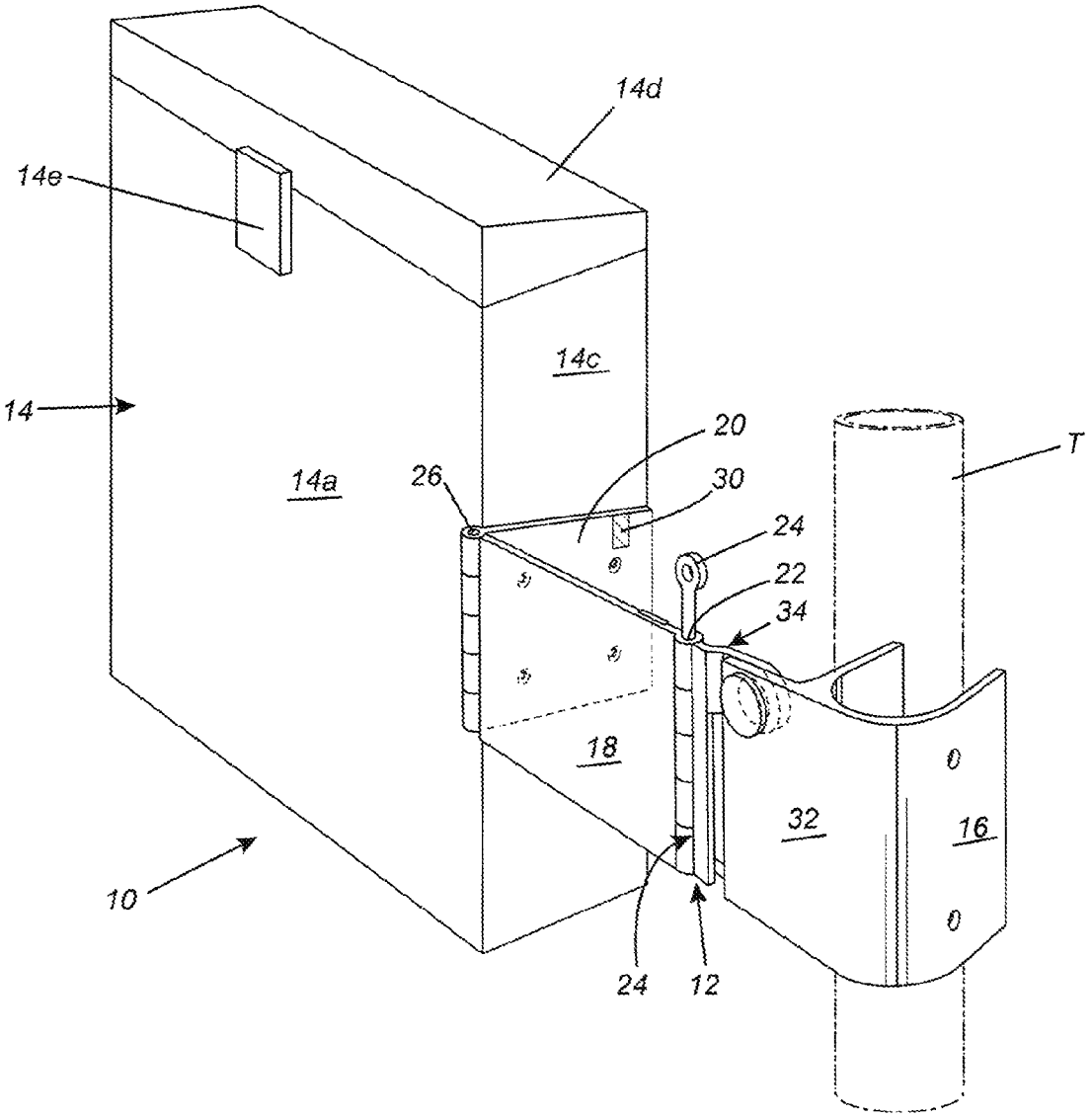
FIG. 3 is a perspective view of the personal storage device in a partially deployed position.

The personal storage transfer device 10 is shown in FIG. 3. A storage container 14 is illustrated as a rigid box having rectangular planar front and rear walls 14*a* and 14*b* as well as end walls 14*c* and a lid 14*d*. A clasp 14*e* is provided to lock the lid 14*d*. The storage container 14 may be of many forms such as an open basket useful to receive various loose articles, small backpacks, purses, computer bag, etc. The container 14 may also be a soft walled bag or other container suitable to be moved between a rear storage position and a side accessible position.

As shown in FIGS. 3 to 8, in a particular embodiment the device 10 includes a mounting bracket 16 which is adapted to be mounted to tubular frame member T. Fasteners such as nuts and bolts 16*a* and 16*b* may be used, passing through the openings provided in the bracket 16 and holes drilled through the tubular frame member T. Other clamp devices may be used to mount bracket 16 to the tubular frame member T but most wheelchair frames have coatings that may be too slippery or soft to offer suitable retention when utilizing known clamping devices. The bracket 16 has an extension 32 to which a hinge assembly 12 is integrated, as will be described hereinafter.

Hinge leaves 18 and 20 are hinged together about hinge pin 26. Hinge leaf 20 is fixed to the end walls 14*c* of container 14. Hinge leaf 18 is hinged to the hinge assembly 12 of the bracket 16 by means of hinge pin 22 which includes hinge pin handle 24 for easy removal of the hinge pin 22 when it is required to detach the personal carrier device 10 from the wheelchair W.

Figure 4:
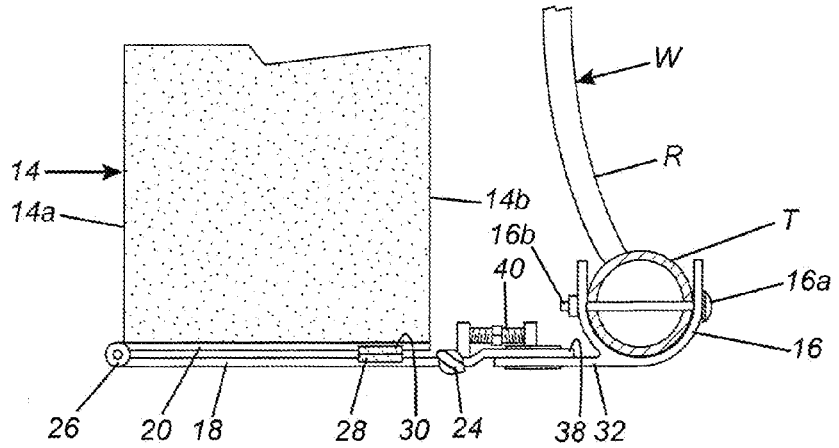
FIG. 4 is a fragmentary, top plan view showing a detail of the embodiment shown in FIG. 3, but in a stored position behind the wheelchair.
Figure 5:
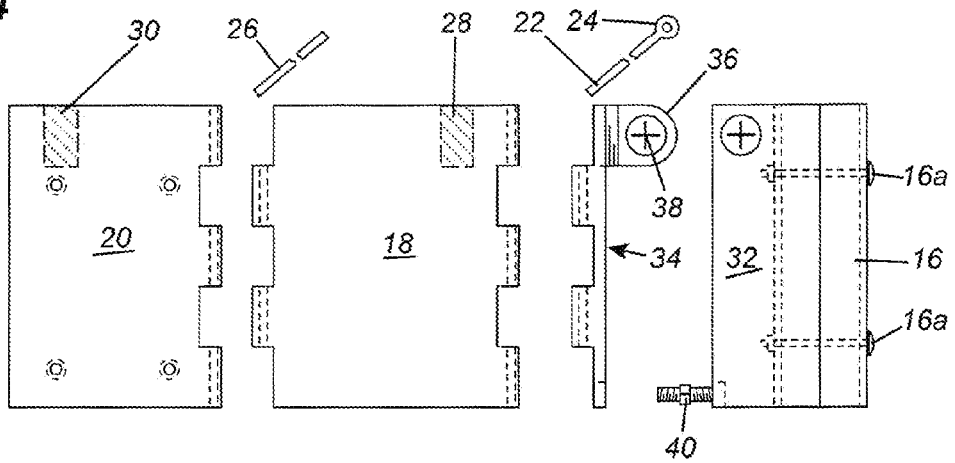
FIG. 5 is an exploded view in side elevation of a detail of the embodiment shown in FIGS. 3 and 4.
Figure 6:
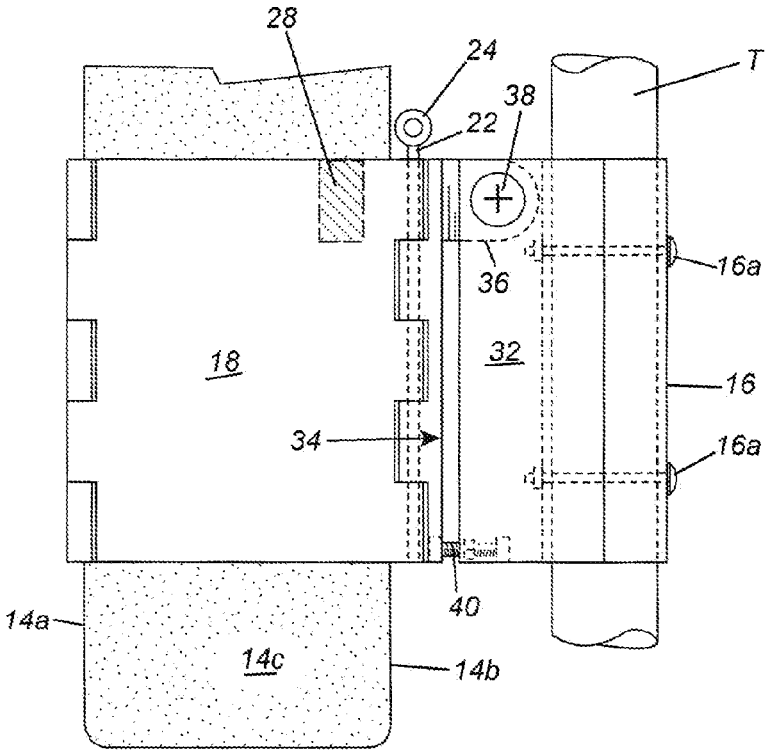
FIG. 6 is a fragmentary, side elevational view of the detail shown in FIG. 4.

Tubular frame members T, forming the backrest support, are rarely exactly vertical. However, in a particular embodiment, it is desired to maintain the arc of rotation in a horizontal plane. Accordingly, to rotate the personal storage transfer device 10 between the rear stored position and the accessible position, a substantially vertical axis of rotation is required to maintain the arc of rotation in a horizontal plane. In a particular embodiment, the arc of rotation has an angle of about 270°. In order to provide a substantially vertical axis of rotation about a pivot pin 22, a pivot assembly is provided. In the embodiment shown, the hinge assembly 12 includes a hinge adapter 34, as shown in FIGS. 4, 5 and 6. The hinge adapter 34 is mounted to the bracket extension 32 by means of a pivot member 38 provided on tab 36 of the hinge adapter 34. Spaced from the pivot member 38 and mounted between the hinge adapter 34 and the bracket extension 32 is a threaded adjustment member 40 extending transversely to the axis of the pivot member 38. Thus, when it is required to mount a new personal storage device 10 to a wheelchair W, the bracket 16 is first fixed, or otherwise clamped, to the tubular frame member T and then the threaded adjustment member 40 is manipulated to adjust its length between the hinge adapter 34 and tab formed by the bracket extension 32 so that the hinge adapter 34 pivots about the pivot member 38 to arrive at a substantially vertical orientation for the axis represented by the pivot pin 22. In a particular embodiment, the axis of the pivot member 38 extends perpendicularly to the axis of the pivot pin 22 and within the plane of the arc of rotation of the device 10, such that the axis of the pivot pin 22 rotates in a plane perpendicular to the axis of the pivot member 38 when the length of the member 40 is adjusted.

Figure 7:
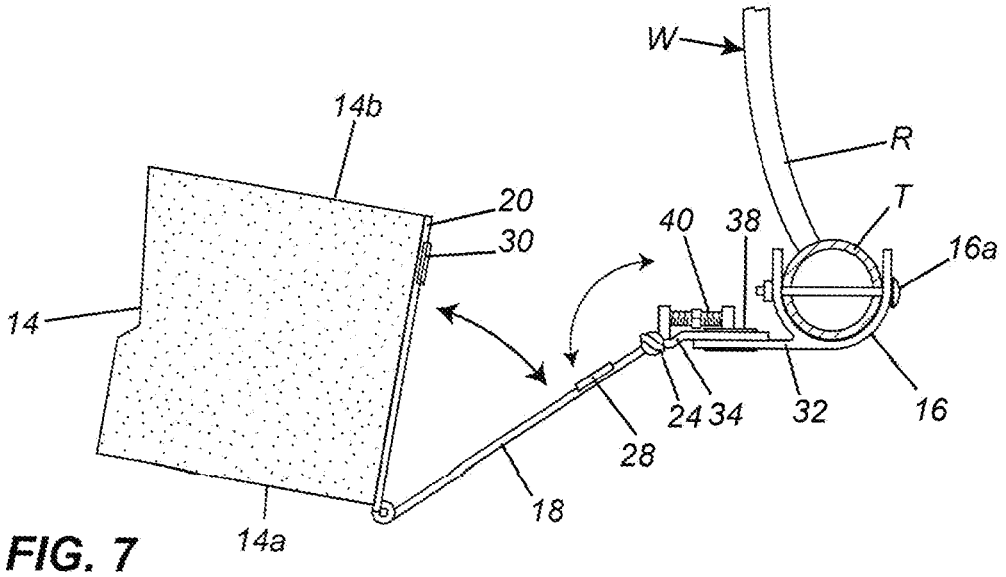
FIG. 7 is a fragmentary, top plan view of the detail shown in FIG. 6 but in a partially deployed position.
Figure 8:
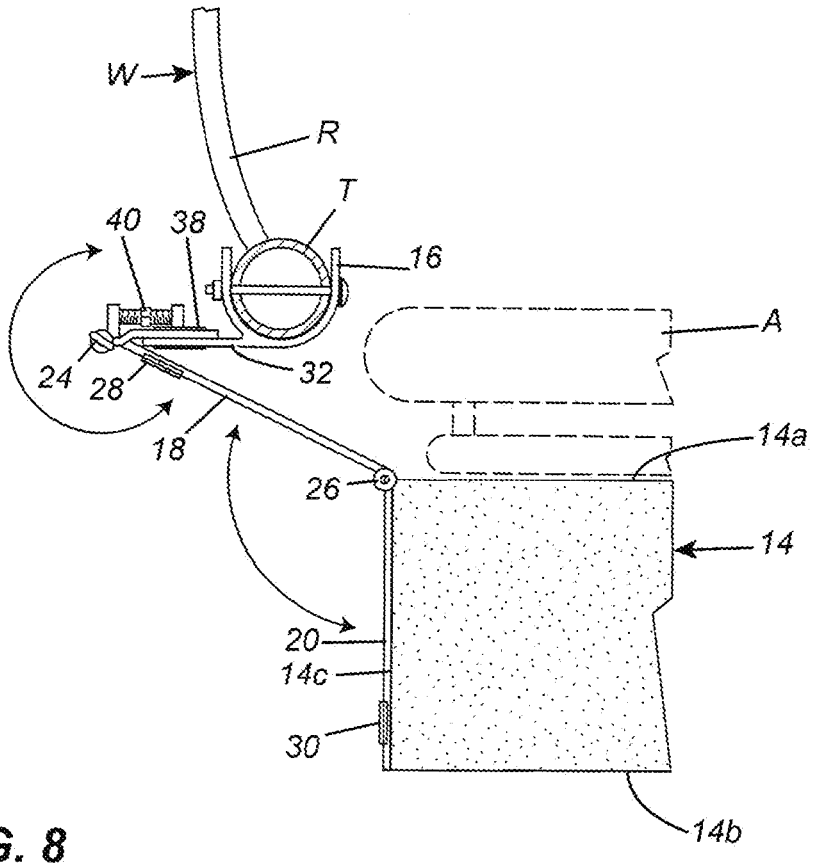
FIG. 8 is a fragmentary, top plan view of the detail shown in FIGS. 6 and 7, but in a fully deployed position, with the storage container adjacent an armrest of the wheelchair.

Magnets 28 and 30 may be provided on hinge leaves 18 and 20 in order to hold the container 14 in its stored position, behind the backrest. FIGS. 4, 7 and 8 show a progressive rotational movement from a stored position shown in FIG. 4, to the accessible position adjacent armrest A, in FIG. 8. Once the user tugs on the container 14 to swivel it around, a force is applied to overcome the attraction of magnets 28 and 30.

A personal storage transfer device in accordance with another embodiment is shown at 110 in FIGS. 9 through 13. In this embodiment, similar elements have been raised by 100. Typically, the backrest R of the wheelchair W has two upstanding, tubular frame members T. The bracket 116 is designed to be mounted to the two tubular frame members T of the backrest R. The bracket 116 includes a pair of spaced apart frame engaging members 117 and 117*a*. As shown in FIG. 10 and FIGS. 11 through 13, the engagement members 117 and 117*a* are mounted to the upstanding tubular frame members T, by means of fasteners. However, the engagement members 117 and 117*a* may be pressure clamps, as previously described with respect to the first embodiment. The bracket 116 also includes a pair of arms 119 and 119*a* which are extensible in order to adapt to different size wheelchairs. Fasteners F may be provided to fix the length of the adjusted arms 119 and 119*a*.

Between the engagement members 117 and 117*a* and the arms 119 and 119*a* is a pivot assembly. The pivot assembly is represented by pivot members 138 and 138*a*. This pivot assembly allows limited rotation of the bracket 116 along a horizontal axis in order to compensate for the relative non-verticality of the tubular frame members T. Each pivot assembly 138, 138*a* includes a pair of tabs 139*a* and 139*b* connected by the pivot pin 138. A cam slot 146 is provided in tab 139*a* while a cam follower 147 is located on the tab 139*b*, the cam follower 147 extending parallel to the axis of the pivot member 138, 138*a*.

A pin-and-socket 134 and 134*a* may also be provided adjacent the hinge assembly 138, 138*a*. Tabs 132 and 132*a* are fixed to the top half of the pin-and-socket 134 and the arms 119 and 119*a* respectively. The pin-and-socket 134, 134*a* arrangements include a pin and base 135 and a socket 135*a*. This pin-and-socket 134 and 134*a* allows the personal storage transfer device 110 to be lifted and removed from the wheelchair W, to which the frame engagement members 117 and 117*a* remain fastened, as shown in dotted lines in FIG. 10.

Figure 9:
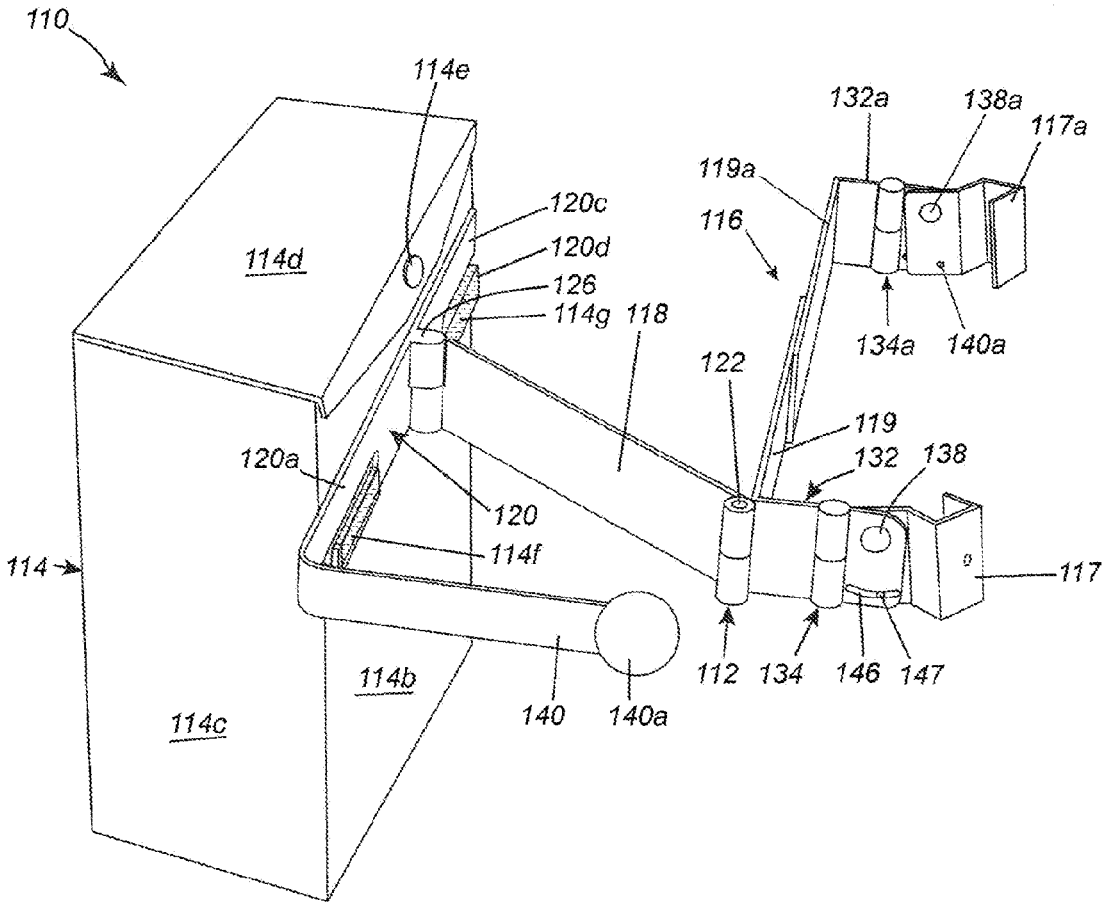
FIG. 9 is a perspective view of a personal storage transfer device in accordance with another embodiment.
Figure 10:
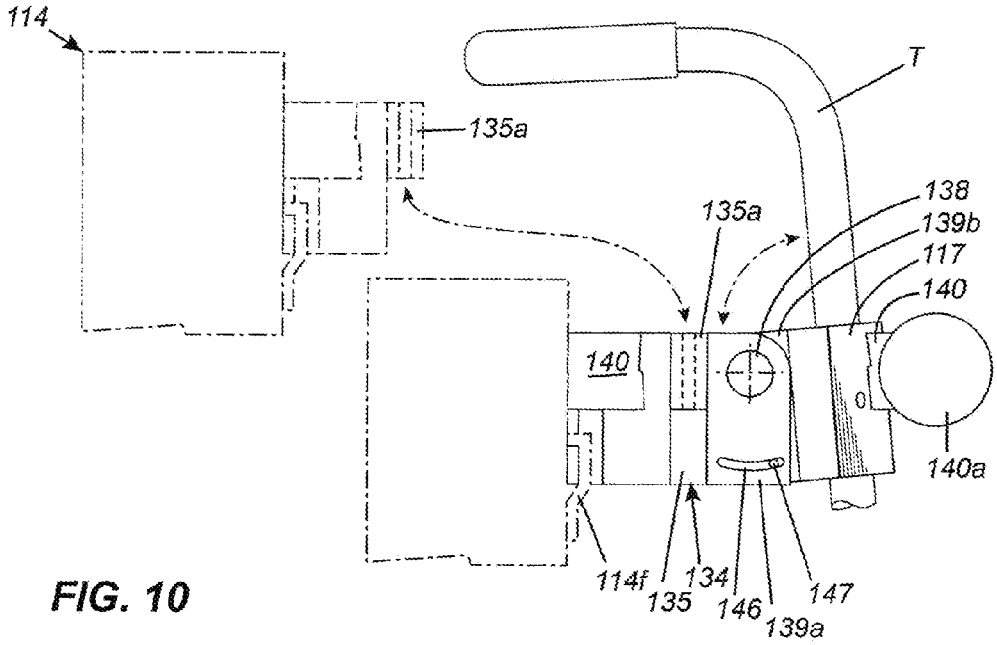
FIG. 10 is a fragmentary, enlarged view, in side elevation, of a detail shown in FIG. 9, but in a stored position behind the wheelchair.

At the intersection of arm 119 and tab 132 is provided the hinge assembly 112 which includes a hinge pin 122 on which the hinge leaf 118 rotates. The hinge assembly 112 can be located either at the intersection of arm 119 and tab 132, as shown in FIG. 9, or at the intersection of arm 119*a* and the tab 132*a*.

A second hinge leaf 120 is rotationally mounted to the hinge leaf 118 by means of the hinge 126. As will be described, the hinge leaf 120 in the present embodiment is slotted at each end as represented by arms 120*a* 120*b*, 120*c* and 120*d*. A pull-arm 140 is integral with the hinge leaf 120.

The hinge leaf 120 with its slotted ends can engage any number of personal storage containers that have straps, such as a backpack. The straps are hung on arms 120*b* and 120*d*, in the slots so formed. Other devices for mounting various personal storage containers may be part of hinge leaf 120. In one of embodiment, the personal storage container may be in the form of a rigid walled container 114. On the rear wall 114*b*, a pair of sleeves 114*f* and 114*g* may be provided to be engaged by arms 120*b* and 120*d* respectively. The sleeve 114*g*, in this embodiment can be opened and closed over the arm 114*g* by means of a Velcro fastener.

Figure 11:
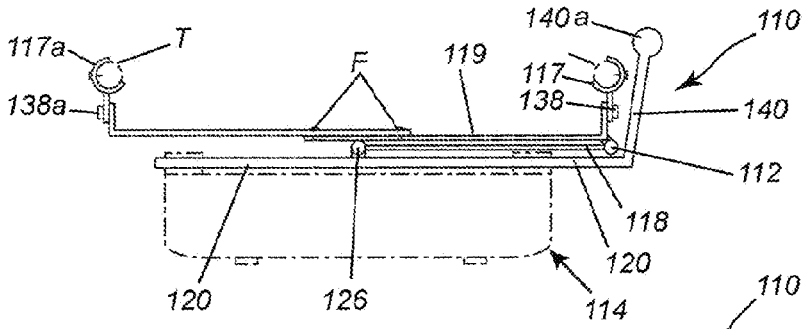
FIG. 11 is a top plan view of the personal storage transfer device shown in FIG. 9.
Figure 12:
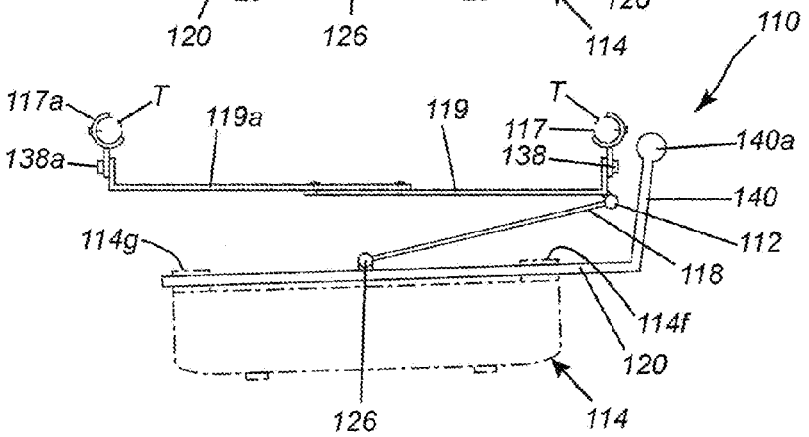
FIG. 12 is a top plan view, similar to FIG. 11, but showing the personal storage transfer device in a partially deployed position.
Figure 13:
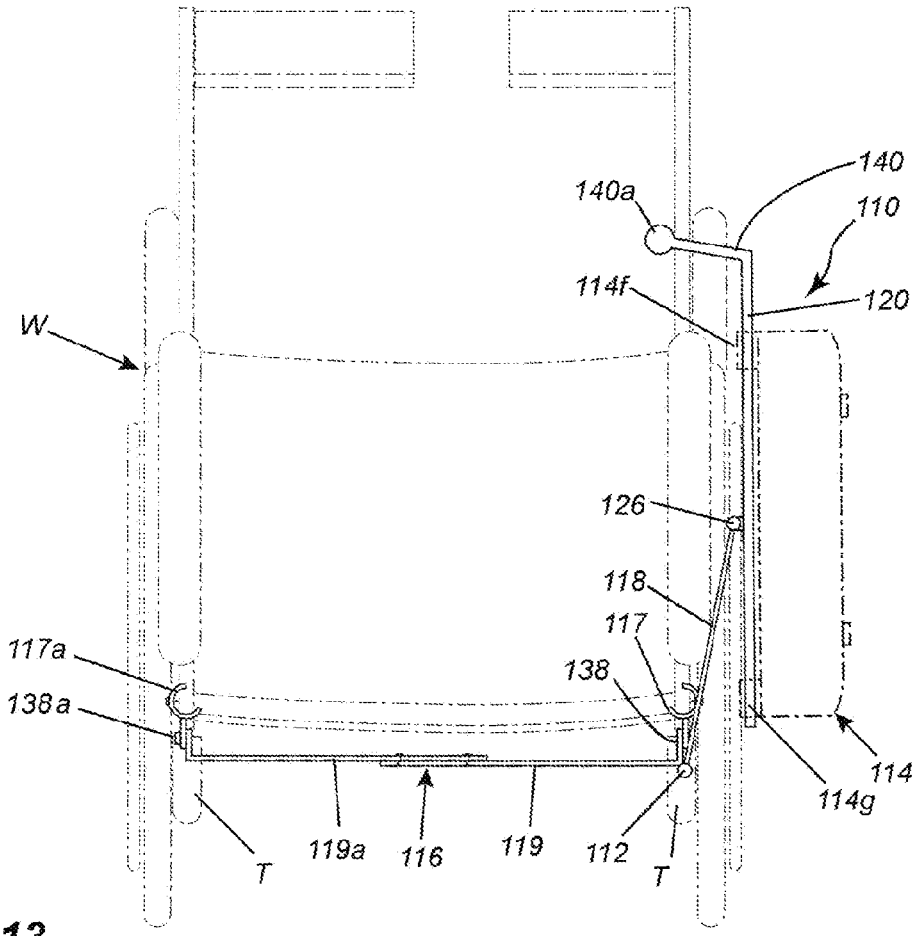
FIG. 13 is a top plan view, similar to FIG. 11, but showing the personal storage transfer device in a fully deployed position.

FIGS. 11 through 13 show the sequential operation in top plan views. In FIG. 11, the personal storage transfer device 110 is shown stored behind the backrest R. In FIG. 12, the user has grasped the handle 140*a*, in order to rotate the storage container 114 towards the side of an arm A of the wheelchair W, as shown in FIG. 13

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A wheelchair accessory comprising a transfer device for moving a personal storage container where the wheelchair includes a backrest frame having a pair of upstanding frame members, the transfer device comprising:

a pair of brackets adapted to be mounted to the pair of upstanding frame members;

a first arm mounted to the brackets;

a swivel mechanism including a first hinge leaf rotationally mounted to the first arm for rotation about a first axis, and a second hinge leaf rotationally mounted to the first hinge leaf about a second axis spaced apart from the first axis, the second hinge leaf having a portion adapted to mount the personal storage container;

a second arm connected to a free end of the second hinge leaf;

wherein the swivel mechanism is movable between a storage position at the rear of the backrest and a deployed position parallel to a side of the wheelchair;

wherein the second arm extends parallel to the side of the wheelchair when the swivel mechanism is in the storage position;

wherein the second hinge leaf is movable along an arc contained within a plane between the storage and the deployed positions when the second arm is retrieved by a user in the wheelchair.

2. The wheelchair accessory as defined in claim 1, wherein the arc defines an angle of 270°.

3. The wheelchair accessory as defined in claim 1, wherein the first arm is mounted to the pair of brackets, and the first arm is adjustable in length between the brackets to accommodate different wheelchair width dimensions.

4. The wheelchair accessory as claimed in claim 3, wherein the first axis between the first arm and the first hinge leaf at one end of the first arm spaced from a respective one of the brackets.

5. The wheelchair accessory as defined in claim 4, wherein the second hinge leaf has a predetermined length suitable for mounting at least one surface of a personal storage container, and the second axis is located midway of the second hinge leaf.

6. The wheelchair accessory as defined in claim 4, wherein the second hinge leaf defines a slotted portion for supporting a container.

7. The wheelchair accessory as defined in claim 1, wherein the second arm is a pull handle is fixed at the free end of the second hinge leaf.

8. The wheelchair accessory as defined in claim 3, wherein the first arm and brackets include a pivot mechanism having a third axis parallel to the plane so that the swivel mechanism is adjustable about the third axis to change the orientation of the plane.

9. The wheelchair accessory as defined in claim 8, wherein the pivot mechanism includes a first tab mounted to a bracket in a second plane normal to the plane, a second tab in a plane parallel to the second plane and rotationally engaged to the first tab for rotation about the third axis, and a movement adjustment member interconnecting the first and second tabs for adjusting and limiting the rotation about the third axis.

10. A personal storage container assembly for a wheelchair movable between a storage position at the rear of a wheelchair to a deployed position at a side of the wheelchair where the wheelchair includes a backrest frame with a pair of spaced apart upstanding frame members, the assembly comprising a personal storage container and a transfer device, the transfer device including a first arm with a bracket for each of the upstanding frame members, and a swivel mechanism including a first hinge leaf rotationally mounted to the first arm for rotation about a first axis, and a second hinge leaf rotationally mounted to the first hinge leaf about a second axis spaced apart from the first axis, the second hinge leaf mounting the personal storage container, a second arm fixed to an end of the second hinge leaf and extending along the side of the wheelchair when the storage container is in the storage position, the swivel mechanism being movable between the storage position and the deployed position on urging of the second arm by a user in the wheelchair, the personal storage container moving along an arc contained within a plane between the storage and the deployed positions, the first and second axes being normal to the plane.

11. The assembly as defined in claim 10, wherein the arc defines an angle of 270°.

12. The assembly as defined in claim 10, wherein the assembly is releasably mounted to the backrest.

13. The assembly as defined in claim 10, wherein the brackets include a pivot assembly having a third axis parallel to the plane so that the swivel mechanism is adjustable about the third axis to change the orientation of the plane.

14. The assembly as defined in claim 10 wherein the container is a soft walled bag having a front wall and a rear wall, the rear wall facing the backrest, the rear wall having a sleeve extending widthwise of the assembly and the second hinge leaf having an arm extending within the sleeve to mount the bag to the transfer device.

* * * * *